US006807991B2

(12) United States Patent
Chiang

(10) Patent No.: US 6,807,991 B2
(45) Date of Patent: Oct. 26, 2004

(54) WOOD PLANING MACHINE WITH A FOLDABLE WORKPIECE-SUPPORTING TABLE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 70 days.

(21) Appl. No.: 10/267,767

(22) Filed: Oct. 9, 2002

(65) Prior Publication Data

US 2004/0003867 A1 Jan. 8, 2004

(30) Foreign Application Priority Data

Jul. 5, 2002 (TW) ..... 91210280 U

(51) Int. Cl.[7] ..... B27C 1/00
(52) U.S. Cl. ..... 144/117.1; 144/130
(58) Field of Search ..... 144/114.1, 117.1, 144/129, 130; 108/1, 6, 64, 65, 67, 162, 115

(56) References Cited

U.S. PATENT DOCUMENTS 4,366,998 A * 1/1983 Kaiser ..... 312/246
4,659,154 A * 4/1987 Jenkins ..... 312/246
6,089,287 A * 7/2000 Welsh et al. ..... 144/130

* cited by examiner

*Primary Examiner*—Allen Ostrager
*Assistant Examiner*—Shelley Self
(74) *Attorney, Agent, or Firm*—Trop, Pruner & Hu, P.C.

(57) ABSTRACT

A wood planing machine includes a base, a plurality of mounting posts extending uprightly from the base, and a cutter carriage mounted slidably on the mounting posts. A workpiece-supporting table is pivoted to a front side of the base, and is movable between a position of use, and an idle position, in which the workpiece-supporting table is perpendicular to the base. A retaining unit includes a first magnetic unit fixed on the workpiece-supporting table, and a second magnetic unit mounted on the cutter carriage and disposed to magnetically attract the first magnetic unit when the table is disposed at the idle position.

2 Claims, 7 Drawing Sheets

WOOD PLANING MACHINE WITH A FOLDABLE WORKPIECE-SUPPORTING TABLE

CROSS REFERENCE TO RELATED APPLICATION

This application claims priority of Taiwan Application No. 091210280, filed on Jul. 5, 2002.

BACKGROUND OF THE INVENTION

1. Field of the Invention

The present invention relates to a wood planing machine, more particularly to a wood planing machine with a foldable workpiece-supporting table.

2. Description of the Related Art

Referring to FIGS. 1 and 2, a conventional wood planing machine is shown to include a base 1 having opposite left and right ends, and opposite front and rear sides 101. Left and right pairs of posts (not visible) extend uprightly and respectively from the left and right ends of the base 1. A cutter carriage (not visible) has left and right carriage ends mounted slidably and respectively on the left and right pairs of posts. The conventional wood planing machine further includes left and right workpiece-supporting tables 3, each of which is pivoted to a lug unit 102 of a respective one of the front and rear sides 101 of the base 1 and each of which is turnable about a rotation axis defined by a pivot 301 between a position of use, as best shown in FIG. 1, in which the workpiece-supporting table 3 is substantially co-planar with the base 1 to permit passage of a workpiece therethrough, and an idle position, as best shown in FIG. 2, in which the workpiece-supporting table 3 is generally perpendicular to the base 1. A pair of supporting bolts 104 (only one is shown in FIGS. 1 and 2) are mounted adjustably and respectively on the front and rear sides 101 of the base 1 so as to support the workpiece-supporting tables 3 when the workpiece-supporting tables 3 are disposed at the position of use. There are further provided a pair of retaining units 2 (only one is shown in FIGS. 1 and 2), each of which is in the form of a leaf spring, and each of which is disposed between the respective workpiece-supporting table 3 and the respective one of the front and rear sides 101 of the base 1 in such a manner that the leaf spring 2 has one end abutting against the base 1 and a middle bent portion urging upwardly a pivot end of the respective workpiece-supporting table 3 when the latter is disposed at the idle position.

Referring to FIG. 2, since the distance "r" from the line of the urging force "f" applied to the pivot end of the workpiece-supporting table 3 by the leaf spring 2 to the rotation axis 301 is relatively short, the resultant torque for retaining the workpiece-supporting table 3 at the idle position is small, thereby disposing the workpiece-supporting table 3 at an unstable state upon transport of the wood planing machine. Moreover, the leaf springs 2 easily suffer from spring fatigue and lead eventually to instabity of the workpiece-supporting tables 3 at the idle position.

SUMMARY OF THE INVENTION

Therefore, the object of this invention is to provide a wood planing machine which includes a magnetic retaining unit which is adapted to retain a foldable workpiece-supporting table firmly when the table is turned to an idle position from a position of use so as to eliminate the drawbacks of the aforesaid prior art.

Accordingly, a wood planing machine of the present invention includes: a base having a horizontal supporting surface and opposite front and rear sides; a plurality of mounting posts extending uprightly from the base; a cutter carriage mounted slidably on the mounting posts and having opposite front and rear side walls; at least one foldable workpiece-supporting table pivoted to the front side of the base, and movable between a position of use, in which the workpiece-supporting table is substantially co-planar with the supporting surface of the base, and an idle position, in which the workpiece-supporting table is perpendicular to the supporting surface of the base; and at least one retaining unit for releasably retaining the workpiece-supporting table at the idle position. The retaining unit includes a first magnetic unit fixed on the workpiece-supporting table, and a second magnetic unit mounted on the front side wall of the cutter carriage and disposed to magnetically attract the first magnetic unit when the workpiece-supporting table is disposed at the idle position so as to retain the workpiece-supporting table at the idle position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
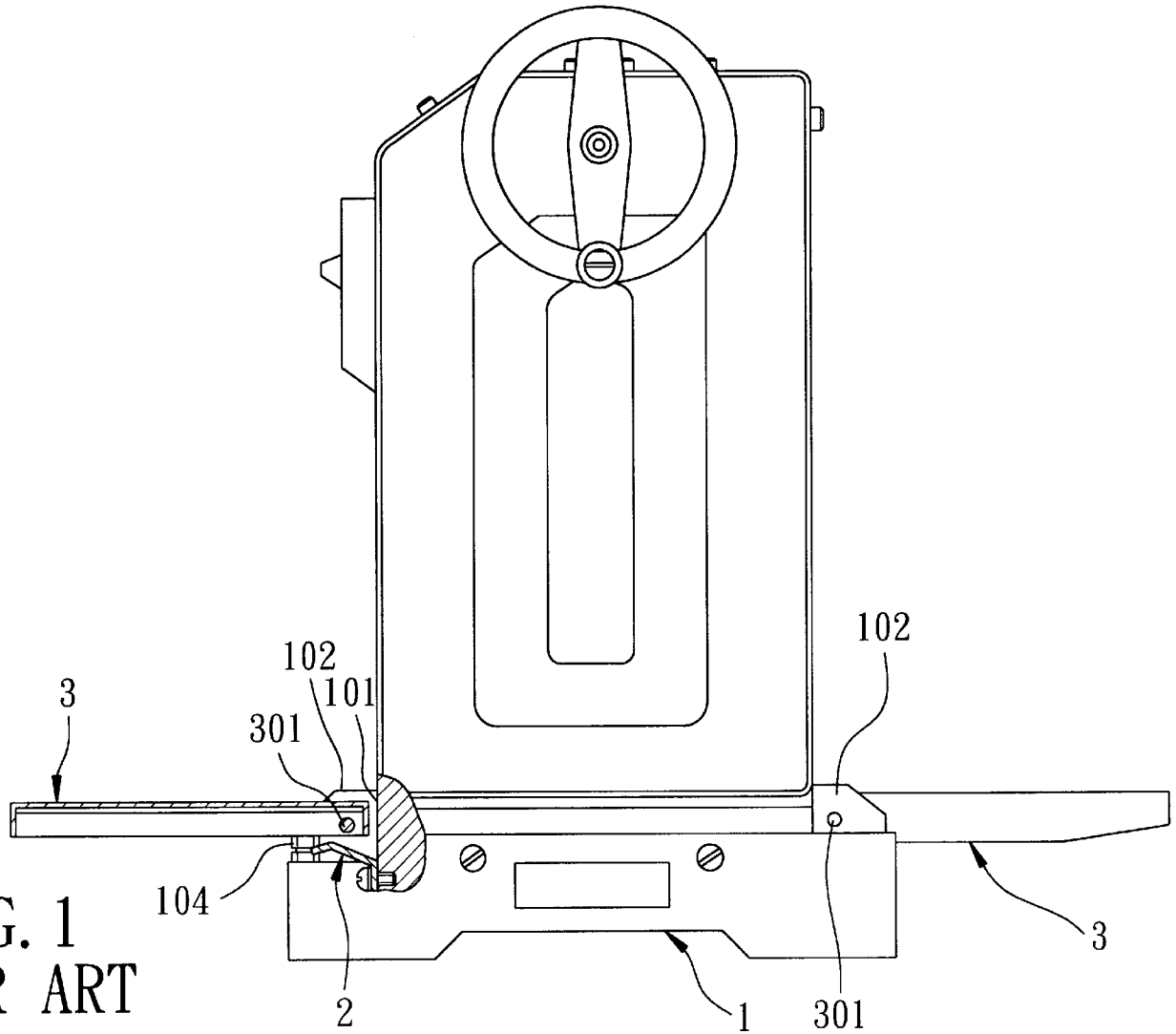
FIG. 1 PRIOR ART
FIG. 1 is a schematic side view of a conventional wood planing machine in a position of use.
Figure 2:
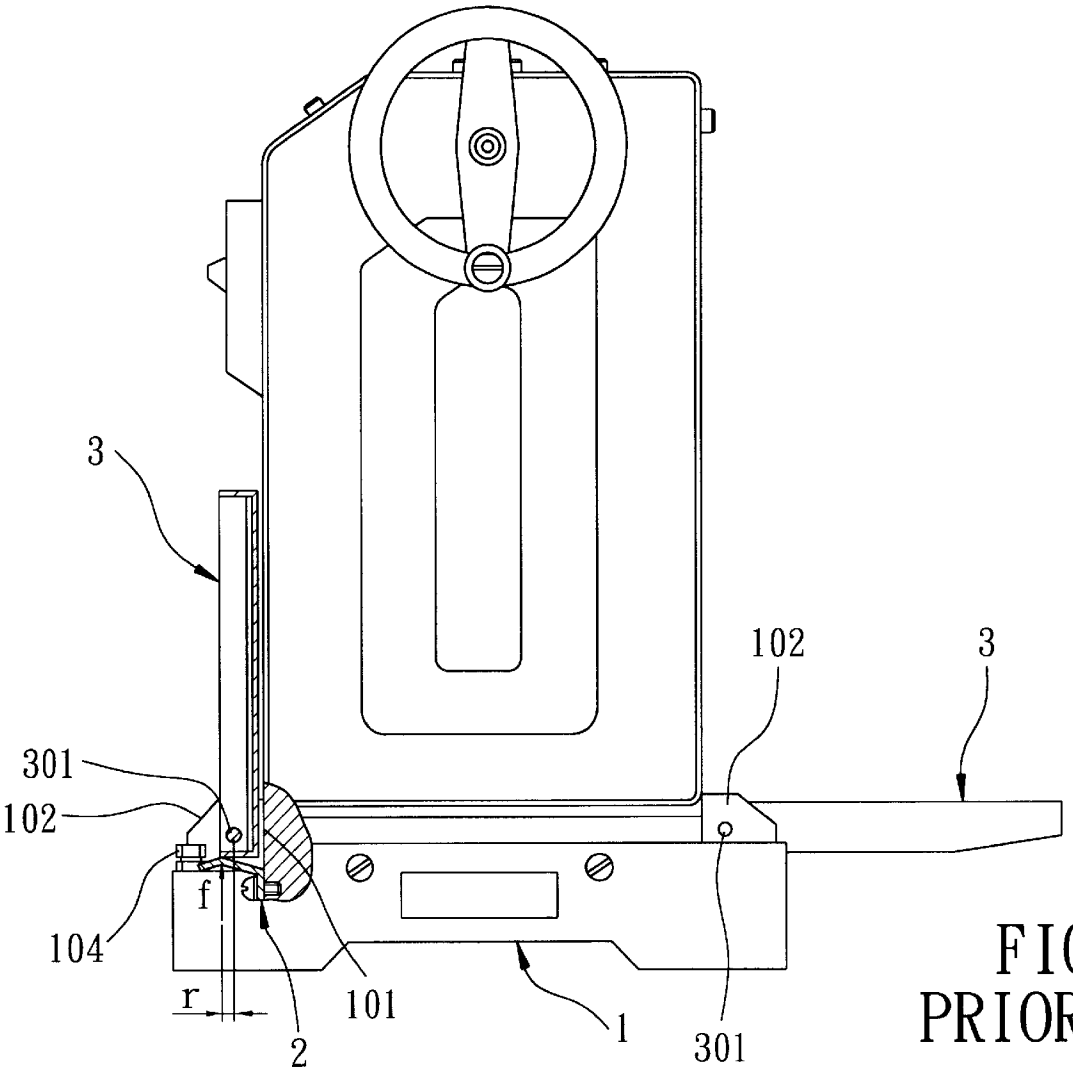
FIG. 2 PRIOR ART
FIG. 2 is a schematic side view of the conventional wood planing machine in an idle position.
Figure 3:
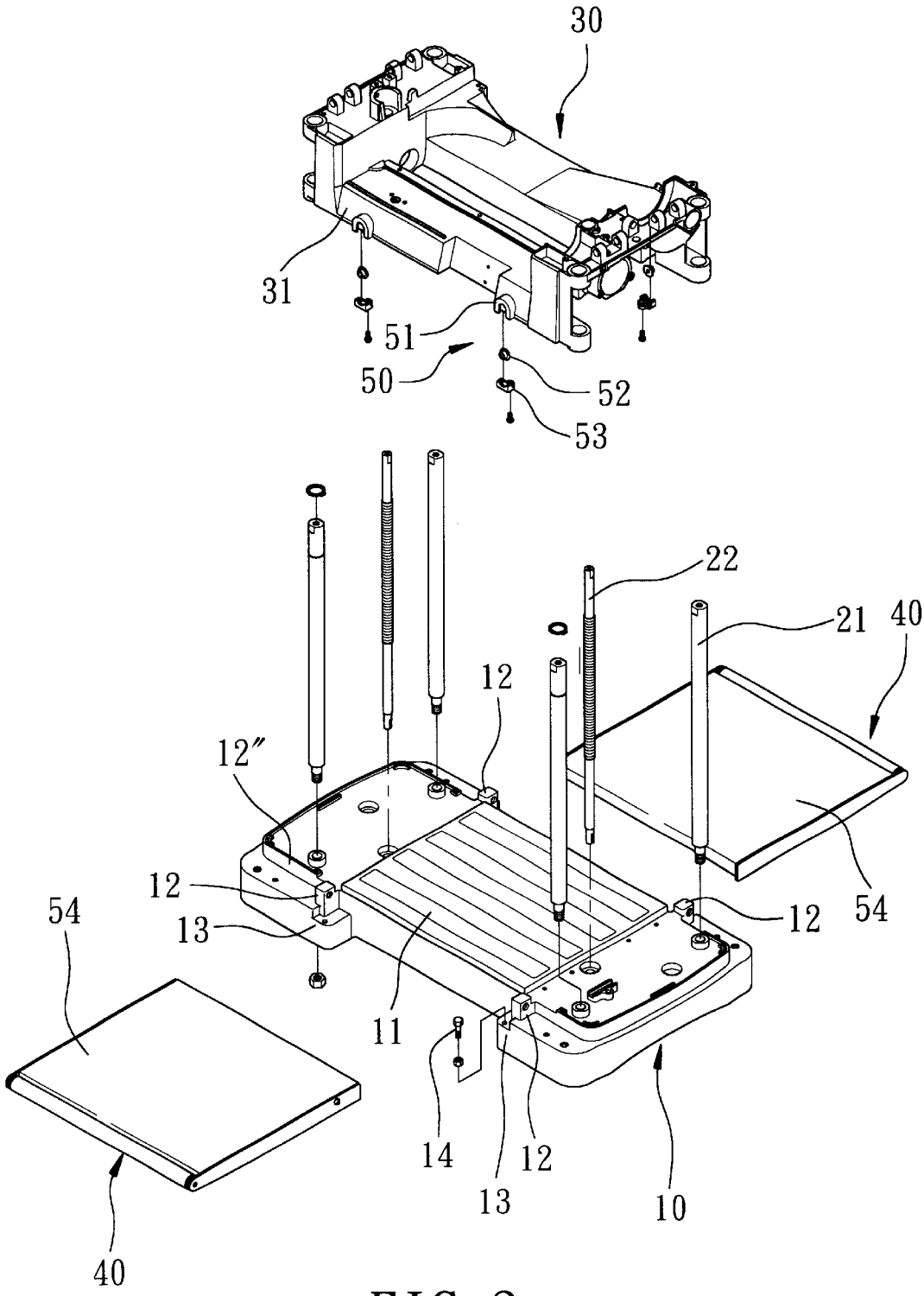
FIG. 3 is an exploded view of a preferred embodiment of a wood planing machine according to the present invention.
Figure 4:
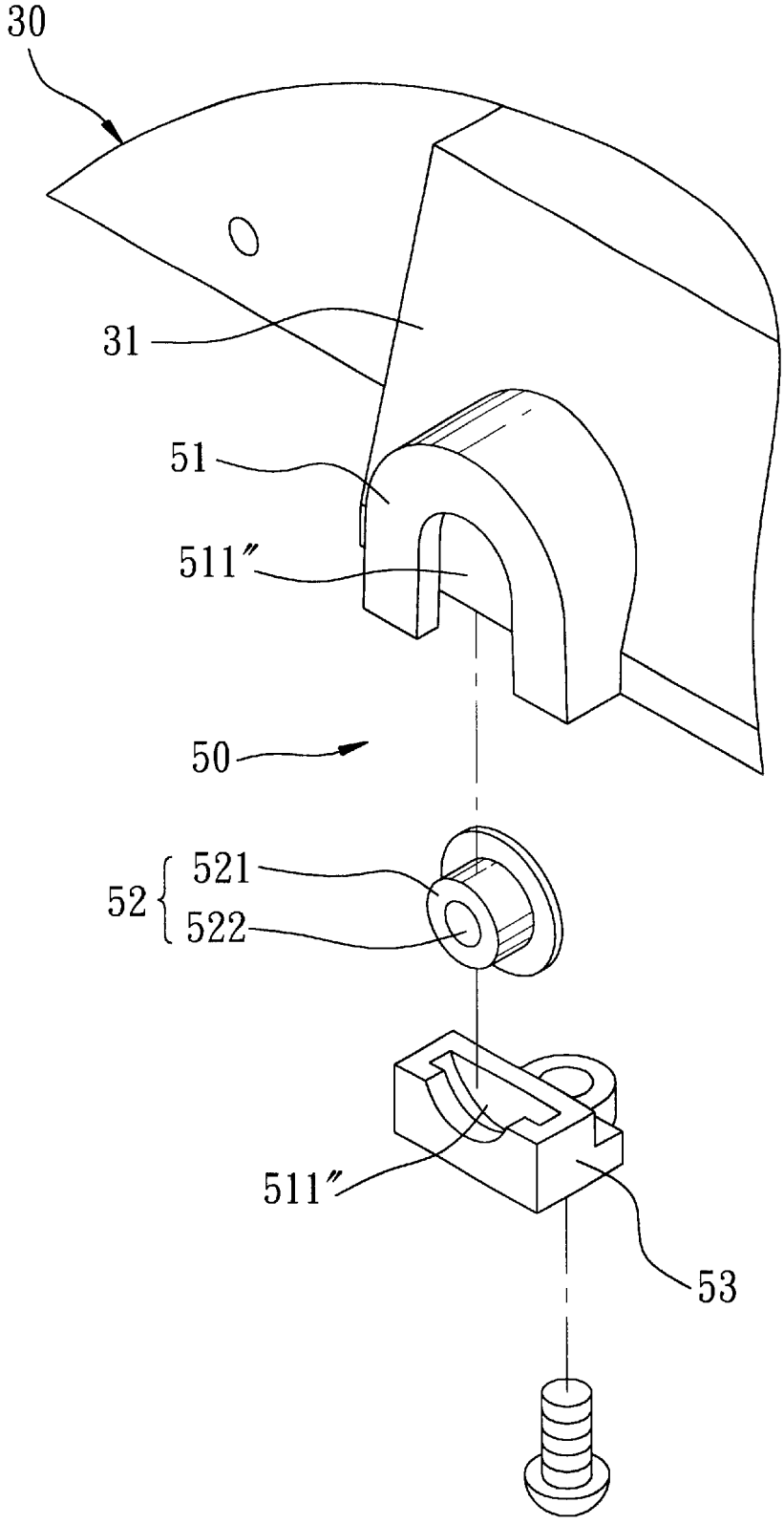
FIG. 4 is a partly fragmentary view of the preferred embodiment, illustrating how a magnetic unit is mounted on a side wall of a cutter carriage.
Figure 5:
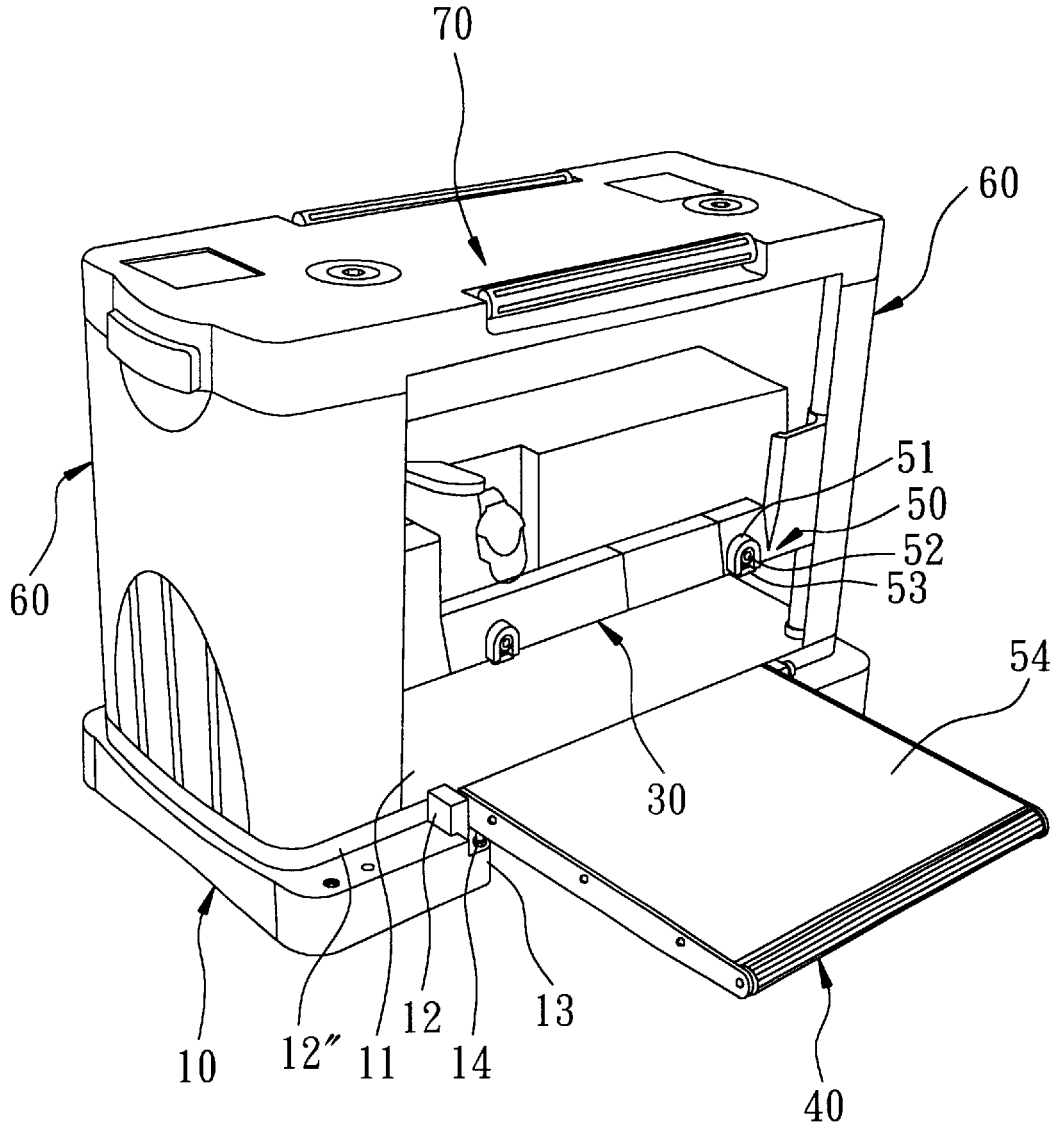
FIG. 5 is a perspective view of the preferred embodiment shown in a position of use.

Referring to FIGS. 3 to 5, the preferred embodiment of a wood planing machine according to the present invention is shown to include a base 10, left and right pairs of mounting posts 21, left and right screw rods 22, a cutter carriage 30, two foldable workpiece-supporting tables 40, and two retaining units 50.

As illustrated, a base 10 has a horizontal supporting surface 11 and opposite front and rear sides 12".

The mounting posts 21 are mounted on the base 10 via four tubular seats, and extend uprightly therefrom.

The cutter carriage 30 is mounted slidably on the mounting posts 21, and has opposite front and rear side walls 31.

The left and right screw rods 22 are disposed between the left and right pairs of the mounting posts 21, respectively, and extend threadedly through two opposite ends of the cutter carriage 30 in such a manner that rotation of the screw rods 22 results in movement of the cutter carriage 30 along the mounting posts 21.

Figure 6:
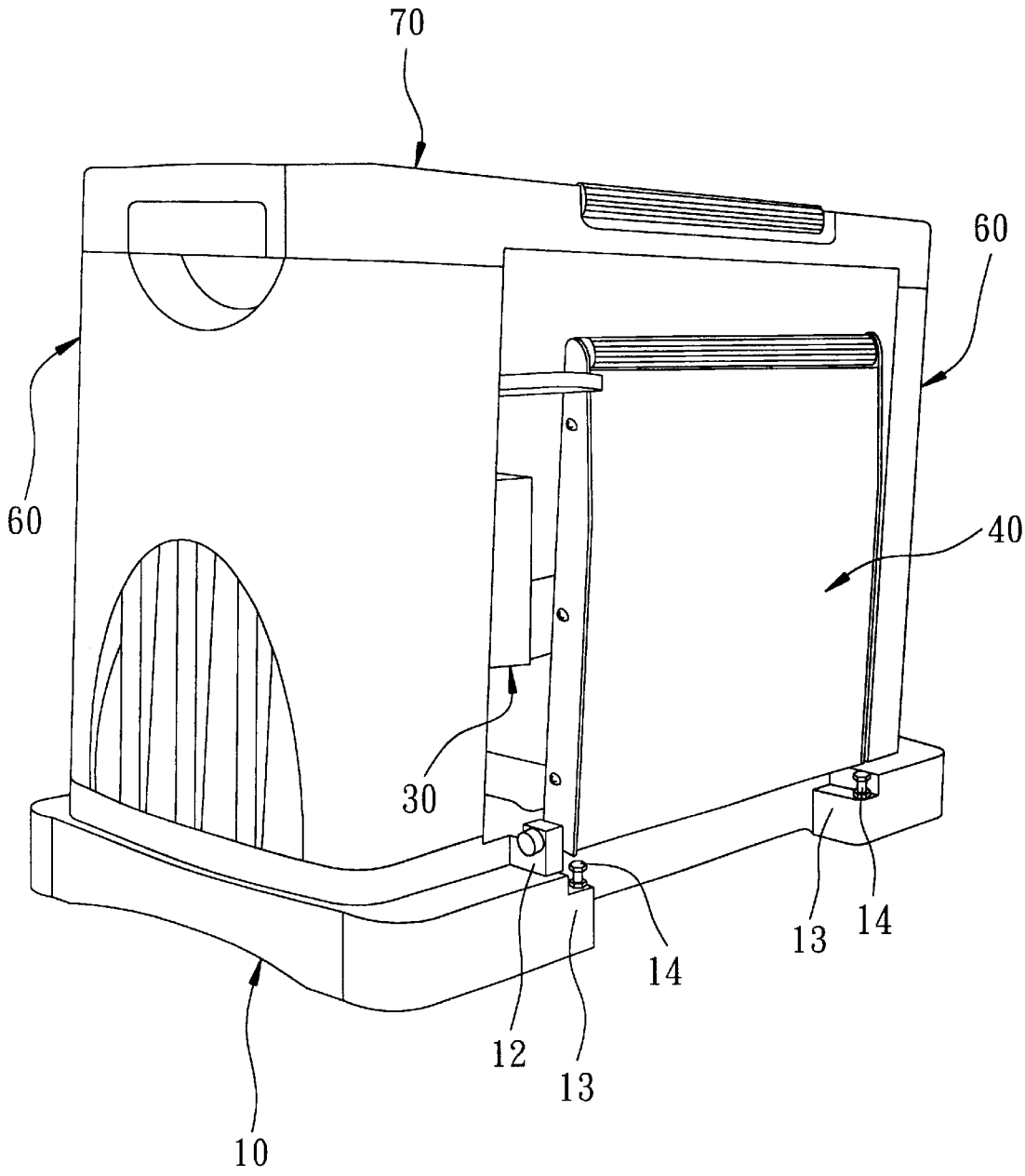
FIG. 6 is a perspective view of the preferred embodiment shown in an idle position.
Figure 7:
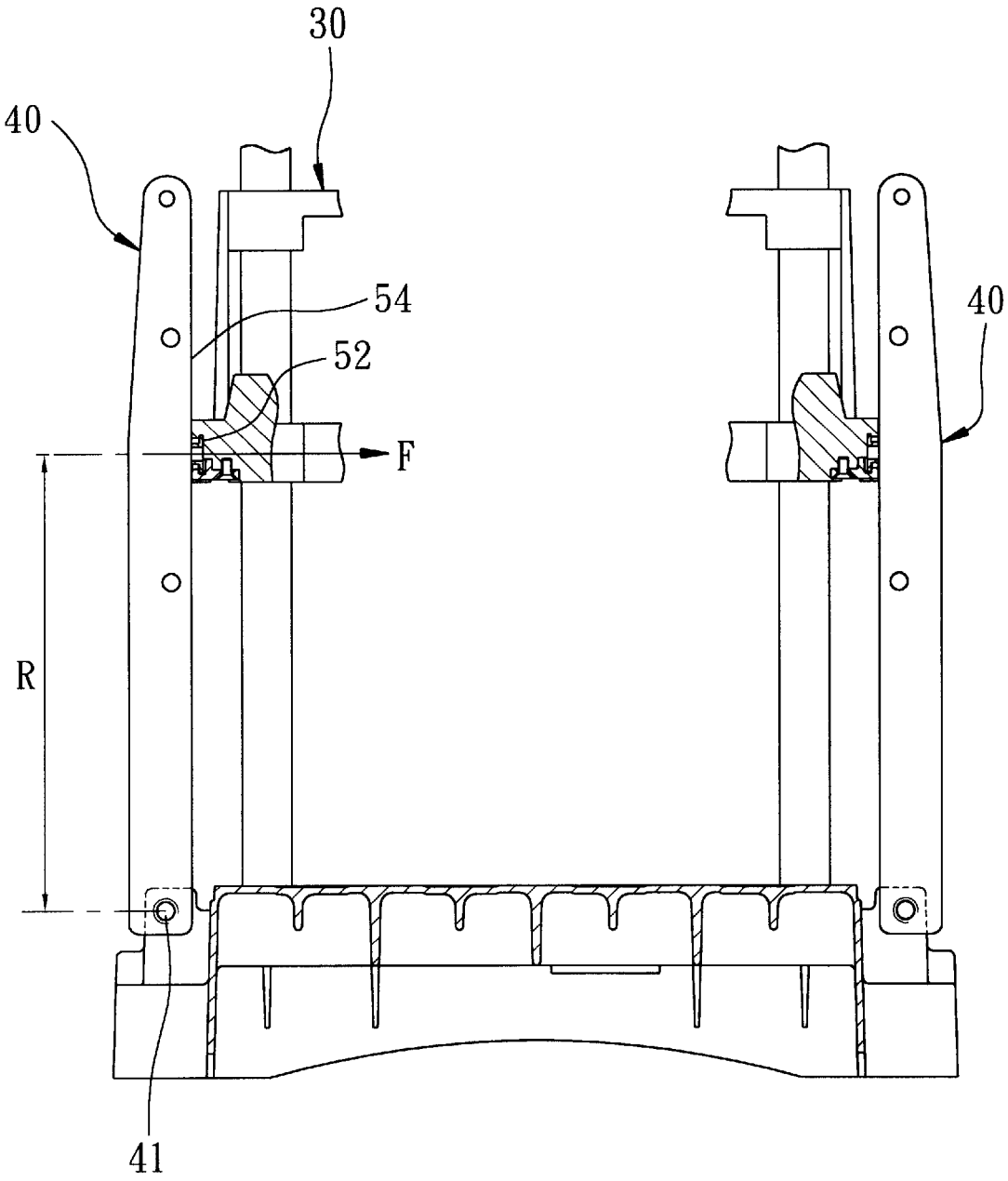
FIG. 7 is a partly schematic sectional view of the preferred embodiment, illustrating how a workpiece-supporting table is retained by the magnetic unit shown in FIG. 4.

Each of the workpiece-supporting tables 40 is pivoted to a respective one of the front and rear sides 12" of the base 10 via a lug unit 12 which projects transversely from the respective one of the front and rear sides 12" of the base 10, and is rotatable about a rotation axis defined by a pivot 41 between a position of use, as best shown in FIG. 5, in which the workpiece-supporting table 40 is substantially co-planar with the supporting surface 11 of the base 10 to permit passage of a workpiece (not shown) therethrough, and an idle position, as best shown in FIGS. 6 and 7, in which the workpiece-supporting table 40 is perpendicular to the supporting surface 11 of the base 10. The base 10 further includes a stepped portion 13 which is disposed below the supporting surface 11, and on which a supporting bolt 14 is mounted adjustably to support the workpiece-supporting table 40 when the latter is disposed at the position of use. Left and right decorative covers 60 of U-shaped cross section extend uprightly from the base 10 to conceal the mounting posts 21 and the screw rods 22. A roof 70 is mounted on the left and right decorative cover 60, and covers the cutter carriage 30.

Each of the retaining units 50 releasably retains a respective one of the workpiece-supporting tables 40 at the idle position, and includes a first magnetic unit 54 and two second magnetic units 52. The first magnetic unit 54 is fixed on the respective workpiece-supporting table 40. The second magnetic units 52 are mounted on a respective one of the front and rear side walls 31 of the cutter carriage 30, and magnetically attracts the first magnetic unit 54 when the respective workpiece-supporting table 40 is disposed at the idle position so as to retain the respective workpiece-supporting table 40 at the idle position.

In this preferred embodiment, each of the workpiece-supporting tables 40 is made from a metal, and has an upper wall that defines the first magnetic unit 54. The preferred embodiment further includes two magnet-mounting seats 51. Each of the magnet-mounting seats 51 includes an inverted U-shaped upper seat half 511 mounted securely on the respective one of the front and rear side wall 31 of the cutter carriage 30, and a lower seat half 53 that is secured to and that cooperates with the upper seat half 511 to define a retaining recess 511" therebetween. Each of second magnetic units 52 includes a headed annular sleeve 521 embedded in the retaining recess 511", and a magnetic cylinder 522 snugly fitted in the sleeve 521.

Referring to FIG. 7, during transport of the preferred embodiment of the present invention, the cutter carriage 30 can be moved upward along the mounting posts 21 away from the rotation axis to increase the distance "R" from the line of attracting force "F" between the first and second magnetic units 54, 52 to the rotation axis so as to increase the torque resulting from the attracting force "F" to retain the respective workpiec-supporting table 40 at the idle position, thereby preventing untimely falling of the respective workpiece-supporting table 40 from the cutter carriage 30.

With this invention thus explained, it is apparent that numerous modifications and variations can be made without departing from the scope and spirit of this invention. It is therefore intended that the invention be limited only as indicated in the appended claims.

I claim:

1. A wood planing machine comprising:

a base having a horizontal supporting surface and opposite front and rear sides;

a plurality of mounting posts extending uprightly from said base;

a cutter carriage mounted slidably on said mounting posts, and having opposite front and rear side walls;

at least one foldable workpiece-supporting table pivoted to said front side of said base, and movable between a position of use, in which said workpiece-supporting table is substantially co-planar with said supporting surface of said base, and an idle position, in which said workpiece-supporting table is perpendicular to said supporting surface of said base; and at least one retaining unit for releasably retaining said workpiece-supporting table at said idle position, said retaining unit including a first magnetic unit fixed on said workpiece-supporting table, and a second magnetic unit mounted on said front side wall of said cutter carriage and disposed to magnetically attract said first magnetic unit when said workpiece-supporting table is disposed at said idle position so as to retain said workpiece-supporting table at said idle position.

2. The wood planing machine as defined in claim 1, wherein said workpiece-supporting table is made from a metal, and has an upper wall defining said first magnetic unit, said wood planing machine further comprising a magnet-mounting seat which includes an inverted U-shaped upper seat half mounted securely on said front side wall of said cutter carriage, and a lower seat half secured to and cooperating with said upper seat half to define a retaining recess therebetween, said second magnetic unit including a headed annular sleeve embedded in said retaining recess, and a magnetic cylinder snugly fitted in said sleeve.

* * * * *